US007388423B1

(12) United States Patent
Lorenz

(10) Patent No.: US 7,388,423 B1
(45) Date of Patent: Jun. 17, 2008

(54) START-UP CIRCUIT WITH FOLDING CURRENT ARRANGEMENT

(75) Inventor: Perry Scott Lorenz, Fort Collins, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 77 days.

(21) Appl. No.: 11/540,124

(22) Filed: Sep. 29, 2006

(51) Int. Cl.
*G05F 1/10* (2006.01)
*G05F 3/02* (2006.01)

(52) U.S. Cl. ..... 327/543; 327/538; 323/315; 323/901

(58) Field of Classification Search ..... 327/538–543; 323/311–315, 901
See application file for complete search history.

(56) References Cited

U.S. PATENT DOCUMENTS 6,528,980 B1 * 3/2003 Smith ..... 323/315
7,276,948 B2 * 10/2007 Mikyska ..... 327/198

OTHER PUBLICATIONS

"LM88 Factory Programmable Dual Remote-Diode Thermostat," *National Semiconductor Corporation,* www.national.com, Aug. 2001, pp. 1-9.

"LM56 Dual Output Low Power Thermostat," *National Semiconductor Corporation,* www.national.com, Jan. 2006, pp. 1-13.

"LM26 SOT-23, ±3° C Accurate, Factory Preset Thermostat," *National Semiconductor Corporation,* www.national.com, Feb. 2006, pp. 1-9.

"LM27 SOT-23, ±3° C Accurate, 120° C-150° C Factory Preset Thermostat," *National Semiconductor Corporation,* www.national.com, Sep. 2006, pp. 1-9.

* cited by examiner

*Primary Examiner*—Tuan T. Lam
*Assistant Examiner*—Patrick O'Neill
(74) *Attorney, Agent, or Firm*—Brett A. Hertzberg; Merchant & Gould

(57) ABSTRACT

A start-up circuit includes a long channel current generator, a subtracting reference current generator, and a gain scaling current mirror-circuit. The long channel current generator circuit uses a long channel transistor circuit that simulates a high value resistor to provide a low-level current. The low-level current is sensed by the subtracting reference current generator to provide a reference current that tracks the low-level current until a diverting current is activated, where the diverting current is subtracted from the reference current such that the reference current increases at a slower rate than the low-level current for increasing supply voltages. The gain scaling current mirror-circuit generates the start-up current as a gain scaled version of the reference current. Once the bias generator circuit is active, a stop-current can be used to shut down the gain scaling current mirror-circuit to conserve current.

20 Claims, 3 Drawing Sheets

START-UP CIRCUIT WITH FOLDING CURRENT ARRANGEMENT

FIELD OF THE INVENTION

The present invention relates to start-up circuits that are useful electronic systems to ensure proper operation of circuits after power is activated. In particular, the present invention relates to a start-up circuit that employs a long channel device or long channel devices that achieve space efficient operation in a folding current mirror arrangement.

BACKGROUND

Typical microelectronic systems have various electronic components that often share one or more common biasing circuits. Examples of circuits that have common biasing arrangements include current sources, operational amplifiers, comparators, as well as other various analog functions.

Most biasing circuits that utilize metal oxide semiconductor (MOS) type transistors which have two stable operating states, one state where the MOS transistor is on or active, and another state where the MOS transistor is off or inactive. Since biasing circuits do not provide any utility when the transistors are off, a start-up circuit is often used to ensure that the biasing circuit reaches an active operating state after power is applied. Many biasing circuits have the desirable property that after they complete the task of ensuring active operation they cease to influence the operation of the biasing circuit with as little current consumption as possible.

BRIEF DESCRIPTION OF THE DRAWINGS

Non-limiting and non-exhaustive embodiments are described with reference to the following drawings.

DETAILED DESCRIPTION

Figure 1A:
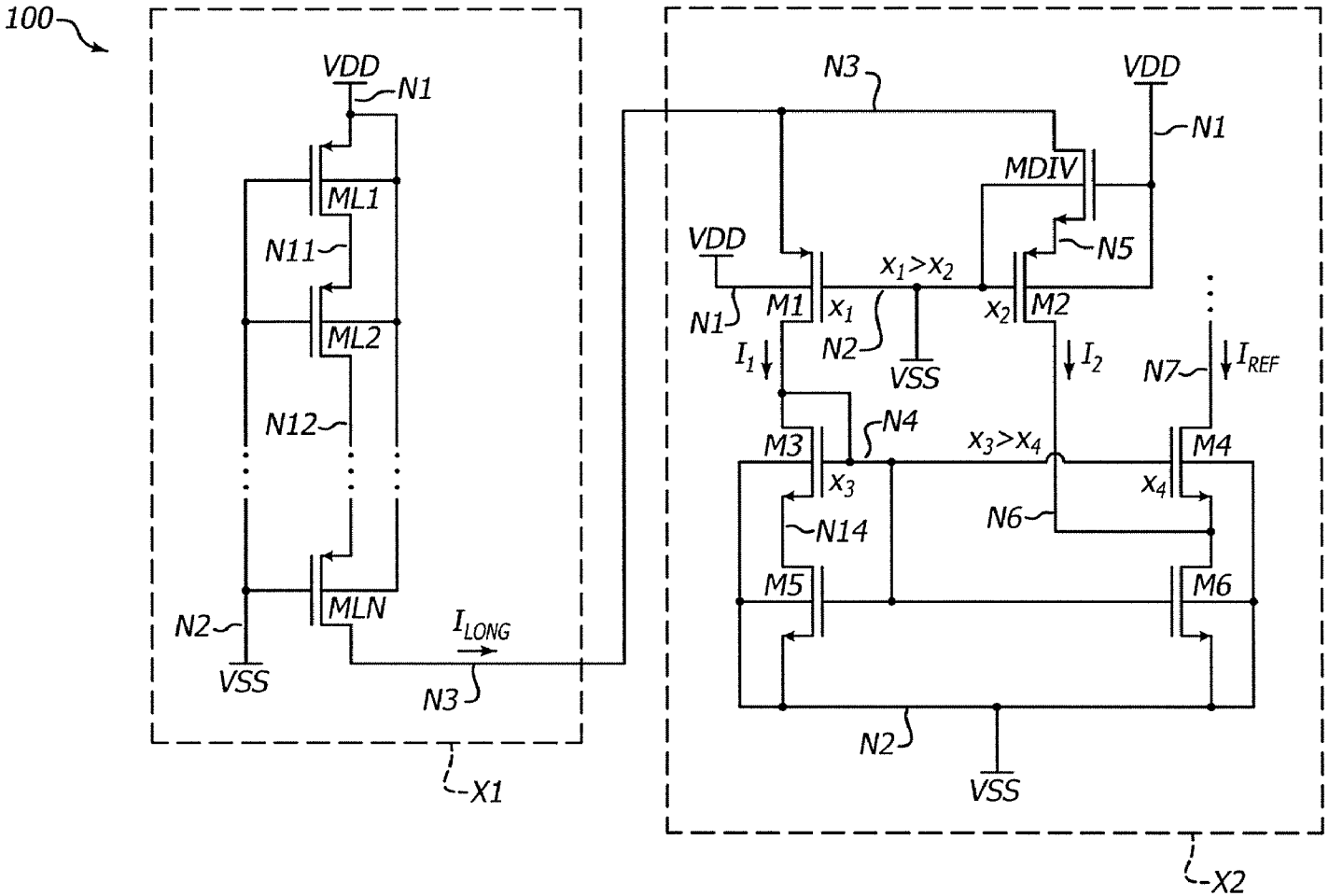
FIGS. 1A and 1B form a schematic diagram illustrating a start-up circuit that is arranged in accordance with the present disclosure.

Various embodiments will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for use of the terms. The meaning of "a," "an," and "the" may include reference to both the singular and the plural. The meaning of "in" may include "in" and "on." The term "connected" may mean a direct electrical, electro-magnetic, mechanical, logical, or other connection between the items connected, without any electrical, mechanical, logical or other intermediary therebetween. The term "coupled" can mean a direct connection between items, an indirect connection through one or more intermediaries, or communication between items in a manner that may not constitute a connection. The term "circuit" can mean a single component or a plurality of components, active and/or passive, discrete or integrated, that are coupled together to provide a desired function. The term "signal" can mean at least one current, voltage, charge, data, or other such identifiable quantity Briefly stated, the present disclosure generally relates to a start-up circuit that includes a long channel current generator, a subtracting reference current generator, and a gain scaling current mirror-circuit. The long channel current generator circuit uses a long channel transistor circuit that simulates a high value resistor to provide a low-level current. The low-level current is processed by the subtracting reference current generator to provide a reference current that tracks the low-level current until a diverting current is activated, where the diverting current is subtracted from the reference current such that the reference current increases at a slower rate than the low-level current for increasing supply voltages. The gain scaling current mirror-circuit generates the start-up current as a gain scaled version of the reference current. Once the bias generator circuit is active, a stop-current can be used to shut down the gain scaling current mirror-circuit to conserve current.

Figure 1B:
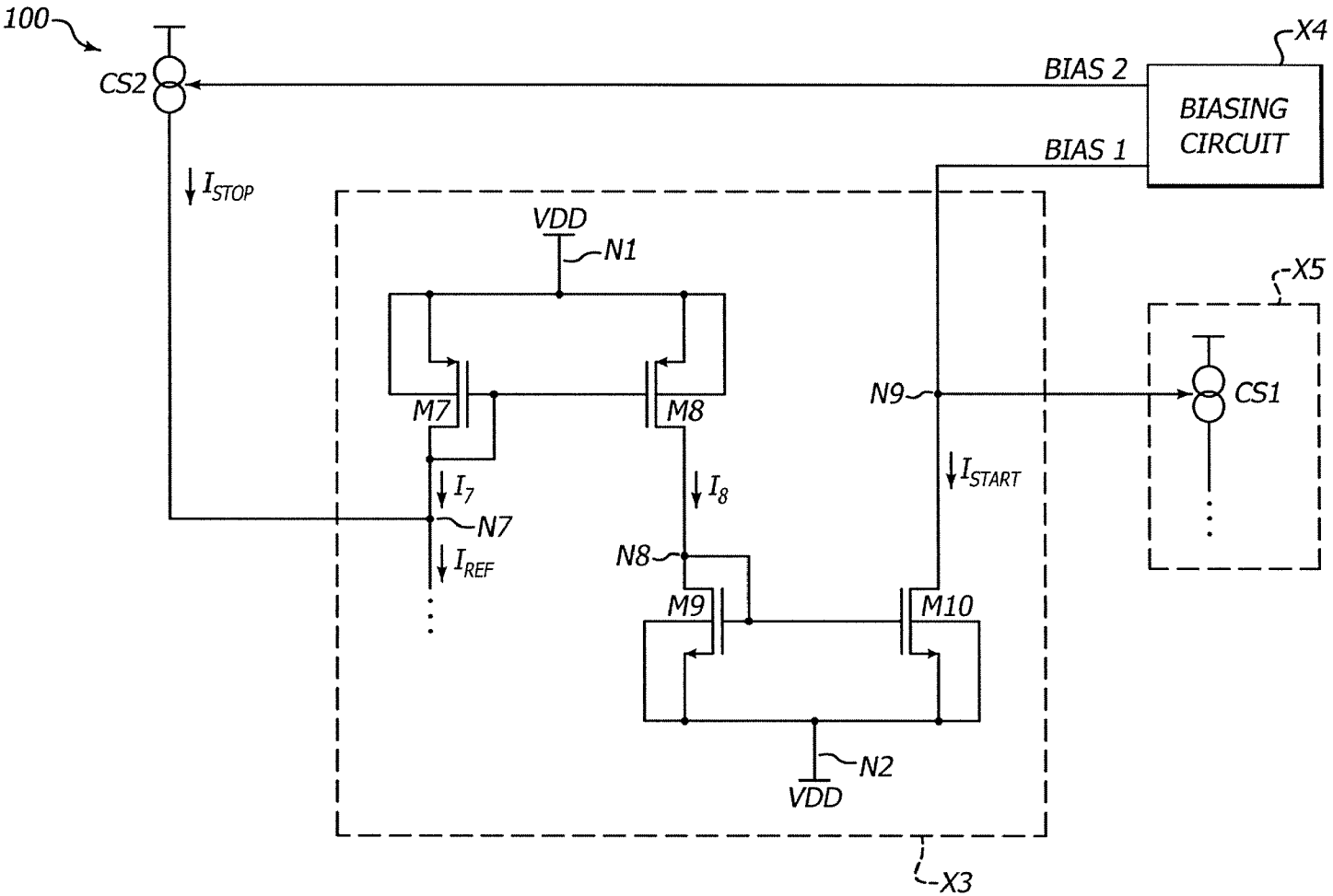

FIGS. 1A and 1B form a schematic diagram illustrating a start-up circuit (100) that is arranged in accordance with the present disclosure. Circuit 100 includes a long channel current generator (X1), a subtracting reference current generator (X2), and a gain scaling current mirror-circuit (X3). Circuit 100 is arranged to ensure proper operation of a biasing circuit (X4), which may be used to provide biasing to additional circuits (X5).

The long channel current generator (X1) includes a long channel MOS transistor circuit that can be represented as an array of N series coupled transistors (ML1, ML2 . . . MLN). Transistor ML1 includes a source and body coupled to node N1, a gate coupled to node N2, and a drain coupled to node N11. Transistor ML2 includes a source coupled to node N11, a body coupled to node N1, a gate coupled to node N2, and a drain coupled to node N12. Transistor MLN includes a source coupled to node N13, a body coupled to node N1, a gate coupled to node N2, and a drain coupled to node N3. Node N13 can be coupled to additional series transistors (e.g., ML3, ML4, etc.) that are similarly coupled together between nodes N12 and N13. During operation, an output current (ILONG) is provided by the drain of transistor MLN at node N3.

The long channel MOS transistor circuit is represented as a series array in FIG. 1A. In one example MOS transistor circuit, there are nine series coupled transistors (N=9) that each have a gate width of 0.5 μm and a gate length of length of 100 μm. This example can also be approximately represented by a single device with a gate width of 0.5 μm and a gate length of 900 μm. For this example implementation, the output current (ILONG) ranges up to approximately 100 nA for a power supply voltage (i.e., the difference between VDD and VSS) of 5.5V. The equivalent resistance of the long channel MOS transistor circuit is approximately 45 MOhms on a 5.5V supply. Since a 45 MOhm resistor would take up an impractical amount of space on a conventional integrated circuit, the long channel implementation provides a significant space savings that can be more readily realized.

In some implementations, the long channel MOS transistor circuit is a single device that is designed as a single gate area that has a very long channel length (e.g., greater than 500 um in some examples). In other implementations, the long channel MOS transistor circuit can be a single device that is designed as N gate areas that each forms one part of the overall device. In still other implementations, the long channel MOS transistor may include a combination of series and/or parallel arranged transistor devices that provide the current (ILONG) with the desired range of equivalent resistances.

The present disclosure admits of p-type MOS devices for the long channel current generator (X1) shown in FIG. 1A. For this example implementation, node N1 corresponds to an upper power supply voltage (VDD) and node N2 corresponds to a lower power supply voltage (VSS). These example devices were selected based on the available process technology and are not intended to be limiting. In other implementations, n-type MOS devices can be used where the body connections at node N1 correspond to the lower power supply voltage (VSS), and where node N2 corresponds to the upper power supply voltage (VDD).

The subtracting reference current generator (X2) includes seven MOS transistors (M1-M6 and MDIV) that are arranged as a current mirror circuit that is intentionally imbalanced. Transistor M1 includes a source coupled to node N3, a gate coupled to node N2, a drain coupled to node N4, and a body coupled to node N1. Transistor M2 includes a source coupled to node N5, a gate coupled to node N2, a drain coupled to node N6, and a body coupled to node N1. Transistor MDIV includes a source coupled to node N5, a gate coupled to node N1, a drain coupled to node N3, and a body coupled to node N2. Transistor M3 includes a source coupled to node N14, a gate and drain coupled to node N4, and a body coupled to node N2. Transistor M4 includes a source coupled to node N6, a gate coupled to node N4, a drain coupled to node N7, and a body coupled to node N2. Transistor M5 includes a source and body coupled to node N2, a gate coupled to node N4, and a drain coupled to node N14. Transistor M6 includes a source and body coupled to node N2, a gate coupled to node N4, and a drain coupled to node N6.

Transistors M1 and M2 share a common gate voltage. During active operation, transistor M1 has an operating current of I1 and transistor M2 has an operating current of I2. If transistor MDIV was eliminated with a short circuit between node N5 and node N3, transistors M1 and M2 would have matched operating currents (I1 and I2) for matched transistors. However, transistors M1 and M2 are non-identical devices, where the effective width-to-length ratio (x1) of transistor M1 is greater than the effective width-to-length ratio (x2) of transistor M2. Since the transistors are intentionally mismatched, transistors M1 and M2 will have a difference in current conduction (again ignoring transistor MDIV) where current I1 is greater than current I2 when both transistors are active.

Transistor MDIV is arranged to operate as an active transistor that is directly biased by the power supply at node N1. Transistor M2 is arranged to operate as an active transistor that is directly biased by the power supply at node N2. Transistors M1 and M2 are arranged such that they are both active when the power supply voltage (i.e., VDD−VSS) reaches two threshold voltages (i.e., the magnitude of the threshold for a p-type MOS device added to the threshold of the n-type MOS device). For power supply voltages that are lower than the requisite threshold voltages, transistor M2 is effectively disabled and all of the current (ILONG) from the long channel current generator (X1) is handled by transistor M1. Once the power supply voltage has exceeded the requisite threshold the current (ILONG) is divided between transistors M1 and M2 as currents I1 and I2, where current I1 exceeds current I2.

Transistors M3 and M4 form a cascode for a first current mirror configuration, where transistor M3 is arranged as a diode coupled device with a common gate configuration with transistor M4. Transistor M3 is arranged to operate with current I1, while transistor M4 is arranged to provide a current at node N7 corresponding to a reference current (IREF). Transistors M3 and M4 enhance the performance of transistors M5 and M6, which form the current mirror as will be described below.

Transistors M5 and M6 form the remainder of the first current mirror configuration, where transistors M5 and M6 have matched effective width-to-length ratios. The conduction current for transistors M5 and M6 is thus matched to current I1. The reference current (IREF) is can now be expressed as a difference of currents where IREF=I1−I2. Since I2=0 when the power supply voltage is below the requisite threshold, IREF=I1 for low power supply voltages (e.g., VDD−VSS<2V). As the power supply voltage increases, transistors MDIV and M2 become active and IREF<I1. Transistor MDIV and M2 effectively divert current away from the reference current (IREF) via current I2. In one example, the transistor size ratios are arranged such that 40% of the current is diverted as away from the reference current for high power supply voltages (e.g., VDD−VSS>3V).

The present disclosure admits of p-type MOS devices for transistors M1 and M2, and n-type MOS devices for transistors (MDIV and M3-M6). For this example implementation, node N1 corresponds to an upper power supply voltage (VDD) and node N2 corresponds to a lower power supply voltage (VSS). These example devices were selected based on the available process technology and are not intended to be limiting. In other implementations, the n-type MOS devices are replaced with p-type devices, and vice-versa, where node N1 correspond to the lower power supply voltage (VSS) and node N2 corresponds to the upper power supply voltage (VDD).

The gain scaling current mirror-circuit (X3) includes four MOS transistors (M7-M10) that are arranged as two current mirrors. The first current-mirror includes transistors M7 and M8, while the second current-mirror includes transistors M9 and M10. Transistor M7 includes a source and body coupled to node N1, and a gate and drain coupled to node N7. Transistor M8 includes a source and body coupled to node N1, a gate coupled to node N7, and a drain coupled to node N8. Transistor M9 includes a source and body coupled to node N2, and a gate and drain coupled to node N8. Transistor M10 includes a source and body coupled to node N2, a gate coupled to node N8, and a drain coupled to node N9.

The biasing circuit (X4) includes a first biasing terminal (BIAS1) that is coupled to node N9, and also coupled to other circuits (X5) that may include current sources (e.g., CS1). For the present example, the biasing circuit will start-up properly when a start-up current (ISTART) is drawn from the biasing terminal. In other examples, the biasing circuit may require the start-up current (ISTART) to be sourced to the biasing terminal for proper start-up, which can simply be provided by coupling another current mirror similar to transistors M7 and M8 to node N9. Once the biasing circuit is operating properly, a stop-current (ISTOP) can be generated by the biasing circuit or by another current source (CS2) that is enabled by the biasing circuit (e.g., via BIAS1 or BIAS2). The stop-current (ISTOP) is coupled to node N7.

Transistors M7 and M8 share a common gate-source biasing voltage. During active operation, transistor M7 has an operating current of I7 and transistor M8 has an operating current of I8. Current I8 is determined by the ratio of the relative transistor sizes (i.e., the length-to-width ratios) for transistors M7 and M8. In one example implementation, transistors M7 and M8 are matched and current I8 is equal to current I7. In another example, transistor M8 has an effective width-to-length ratio that is four times greater than that of transistor M7 (a gain scaling factor of 4) and current I8 is equal to four times current I7. Other gain scaling factors between transistors M7 and M8 are also contemplated such as 2×, 3×, 4×, 5×, etc.

Transistors M9 and M10 also share a common gate-source biasing voltage. During active operation, transistor M9 has an operating current of I8 and transistor M10 has an operating current of ISTART. Current ISTART is determined by the ratio of the transistor sizes (the length-to-width ratios) for transistors M10 and M9. In one example implementation, transistors M10 and M9 are matched and current ISTART is equal to current I8. In another example, transistor M10 has an effective width-to-length ratio that is two times greater than that of transistor M8 (a gain scaling factor of 2) and current ISTART is equal to two times current I8. Other gain scaling factors between transistors M10 and M9 are also contemplated such as 2×, 3×, 4×, 5×, etc.

Current ISTART is related to current I7 by an overall gain scaling factor that is determined by transistors M7-M10. In one example implementation, an overall gain scaling factor of eight is employed such that current ISTART is equal to eight times current I7. However, other gain scaling factors (GAIN) may be desirable based upon various processing technology limitations, power supply voltage ranges, and other criteria.

Current I7 is equal to the reference current (IREF) during initial power up since the stop-current (ISTOP) can be presumed to be zero. For this condition, ISTART is given as ISTART=IREF*GAIN. The start-current (ISTART) activates the biasing circuit by forcing one or more transistors into proper conduction (i.e., one or more transistors in the biasing circuit are forced into active operation). After the biasing circuit begins to operate appropriately, the stop-current (ISTOP) begins flowing into node N7 effectively diverting current from transistor M7. Once the magnitude of the stop current reaches the reference current (|ISTOP|=|IREF|), current I7 is effectively zero and the start-up current is shut off (ISTART=0). Since the reference current (IREF) is diverted away from the gain scaling current mirror (X3) instead of the start-current (ISTART), the overall current consumption of the start-up circuit is reduced by at least a factor of IREF*GAIN.

The present disclosure admits of p-type MOS devices for transistors M7 and M8, and n-type MOS devices for transistors M8 and M10 as illustrated in FIG. 1B. For this example implementation, node N1 corresponds to an upper power supply voltage (VDD) and node N2 corresponds to a lower power supply voltage (VSS). These example devices were selected based on the available process technology and are not intended to be limiting. In other implementations, the n-type MOS devices are replaced with p-type devices, and vice-versa, where node N1 correspond to the lower power supply voltage (VSS), and where node N2 corresponds to the upper power supply voltage (VDD).

Figure 2:
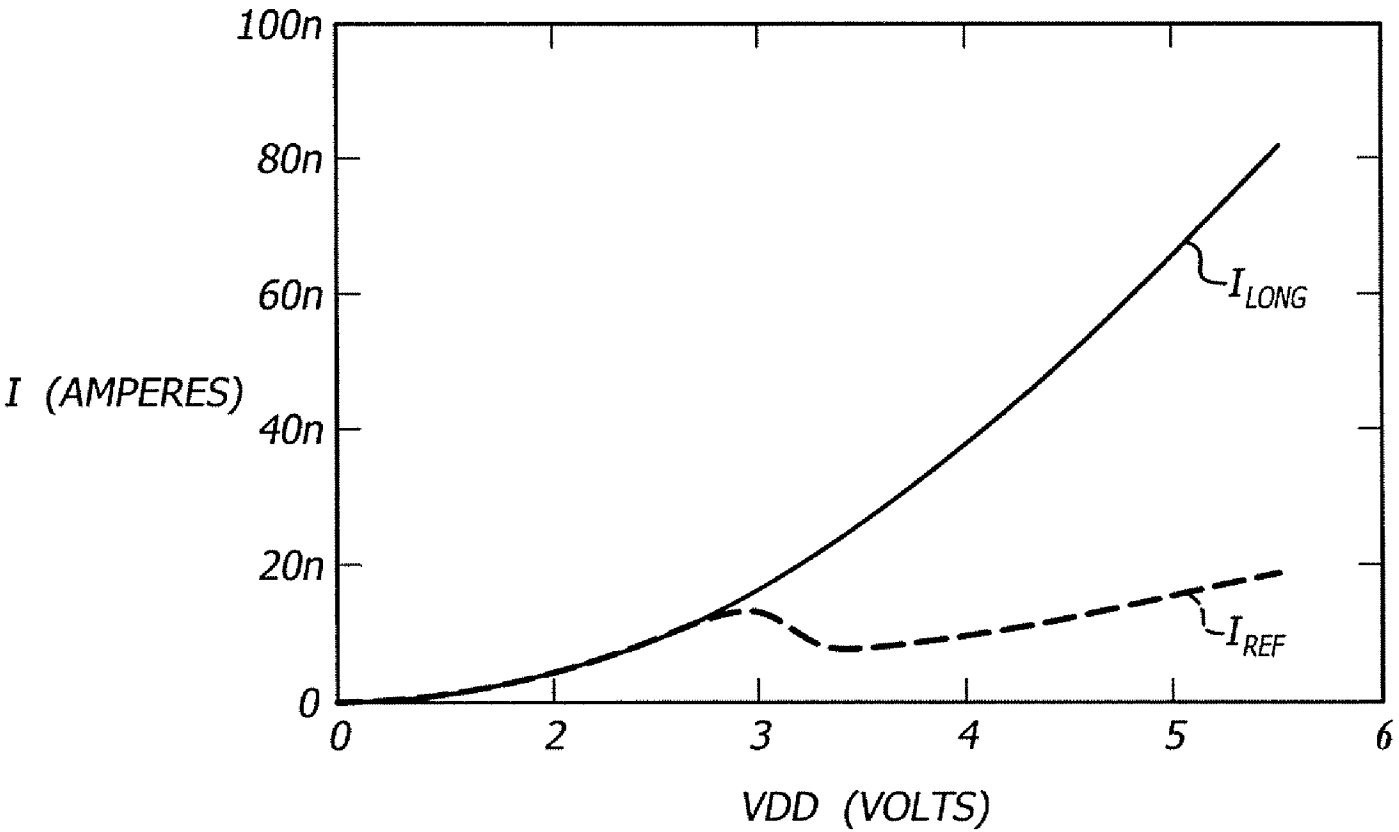
FIG. 2 is a graphical plot illustrating the relationship between the reference current and the power supply voltage for an example implementation of the circuits from FIGS. 1A and 1B, arranged in accordance with the present disclosure.

FIG. 2 is a graphical plot illustrating the relationship between the reference current (IREF) and the power supply voltage for an example implementation of the circuits from FIGS. 1A and 1B, arranged in accordance with the present disclosure. During initial power-up, reference current IREF tracks current ILONG for increasing power-supply voltages. Once the power-supply voltage exceeds the requisite thresholds for transistors MDIV and M2, current is diverted and reference current IREF no longer tracks current ILONG as illustrated in FIG. 2. The overall current consumption of circuit 100 remains relatively low since the gain scaling current-mirror circuit (X3) is effectively disabled by the stop-current (ISTOP, not shown in FIG. 2)

The circuits described herein work over a wide range of power supply voltages with low quiescent currents (e.g., 100 nA range) in a space efficient solution (e.g., the long channel devices eliminate the need for a large resistor). Moreover, the topology is useful at low power-supply voltages (e.g., 2V range) as well as increased power-supply voltages (e.g., 6V range). The topology also functions well over process variations as well as over varied temperature ranges (e.g., −50 deg. C. to 150 deg. C.).

Although the invention has been described herein by way of exemplary embodiments, variations in the structures and methods described herein may be made without departing from the spirit and scope of the invention. For example, the positioning of the various components may be varied. Individual components and arrangements of components may be substituted as known to the art. Since many embodiments of the invention can be made without departing from the spirit and scope of the invention, the invention is not limited except as by the appended claims.

What is claimed is:

1. An apparatus that is arranged to provide a start-up current for a biasing circuit that is powered by a power supply voltage, the apparatus comprising:
   - a long channel current generator circuit that is arranged to provide a low-level current when active;
   - a subtracting reference current generator that provides a reference current when activated, wherein the subtracting reference current generator is arranged such that the reference current tracks the low-level current until a diverting current is activated, and the diverting current is subtracted from the reference current; and
   - a gain scaling current-mirror circuit that is arranged to provide the start-up current for the biasing circuit when the gain scaling current-mirror circuit is active, wherein the start-up current is related to the reference current according to a gain scaling factor.

2. The apparatus of claim 1, the long channel current generator circuit comprising a MOS transistor that includes multiple gate areas, wherein each gate area has a long channel length.

3. The apparatus of claim 1, the long channel current generator circuit comprising an array of series coupled long channel MOS transistors that share a common gate terminal.

4. The apparatus of claim 1, the subtracting reference generator circuit comprising: a first MOS transistor circuit that is arranged to provide a first current in response to the low-level current when active, and a second MOS transistor circuit that is arranged to provide the diverting current in response to the low-level current when active, wherein the first MOS transistor circuit and second MOS transistor circuit are arranged in cooperation such that the reference current corresponds to a difference between the first current and the diverting current.

5. The apparatus of claim 4, wherein the second MOS transistor circuit is further arranged such that the diverting current is substantially zero when inactive.

6. The apparatus of claim 4, wherein the second MOS transistor circuit is further arranged for activation when the power supply voltage reaches an activation threshold corresponding to the sum of the magnitudes of thresholds for a p-type MOS transistor and an n-type MOS transistor.

7. The apparatus of claim 4, wherein the first MOS transistor circuit and the second MOS transistor circuit are arranged in cooperation such that the first current is greater than the diverting current.

8. The apparatus of claim 1, the gain scaling current-mirror circuit comprising: a first MOS transistor that is arranged in a common gate-source configuration with a second MOS transistor, wherein the first MOS transistor is arranged in a diode configuration that senses the reference current when active, and wherein the second MOS transistor is arranged to provide a reflected current when active such that the reflected current is related to the reference current according to a first gain scaling factor.

9. The apparatus of claim 8, wherein the first gain scaling factor is greater than one.

10. The apparatus of claim 8, the gain scaling current-mirror circuit comprising: a third MOS transistor that is arranged in a common gate-source configuration with a fourth MOS transistor, wherein the third MOS transistor is arranged in a diode configuration that senses the reflected current when active, and wherein the fourth MOS transistor is arranged to provide a second reflected current when active such that the second reflected current is related to the reflected current according to a second gain scaling factor, wherein the gain scaling factor corresponds to the multiplication of the first and second gain scaling factors.

11. The apparatus of claim 10, wherein the second gain scaling factor is greater than one.

12. The apparatus of claim 8, wherein the gain scaling current-mirror circuit is deactivated in response to a stop-current associated with the biasing circuit.

13. The apparatus of claim 12, wherein the stop-current is provide by a current source that is biased when the biasing circuit is active.

14. An apparatus that is arranged to provide a start-up current for a biasing circuit that is powered by a power supply voltage, the apparatus comprising:

a long channel current generator means that is arranged to provide a low-level current when active;

a subtracting reference current generator means that provides a reference current when activated, wherein the subtracting reference current generator means is arranged such that the reference current tracks the low-level current until a diverting current is activated, and the diverting current is subtracted from the reference current; and a gain scaling current-mirror means that is arranged to provide the start-up current for the biasing circuit when the gain scaling current-mirror circuit is active, wherein the start-up current is related to the reference current according to a gain scaling factor.

15. An apparatus that is arranged to generate a start-up current for a biasing circuit that is powered from a power supply voltage that is applied across a first node and a second node, the apparatus comprising:

a long channel MOS transistor that includes a source coupled to the first node, a gate coupled to the second node, and a drain coupled to a third node;

a first MOS transistor that includes a source coupled to the third node, a gate coupled to the second node, and a drain coupled to a fourth node;

a second MOS transistor that includes a source coupled to a fifth node, a gate that is coupled to the second node, and a drain that is coupled to a sixth node;

a third MOS transistor that includes a source coupled to the sixth node, a gate coupled to the fourth node, and a drain coupled to a seventh node;

a fourth MOS transistor that includes a source coupled to the first node, a gate and drain coupled to the seventh node; and a fifth MOS transistor that includes a source coupled to the first node, a gate coupled to the seventh node, and a drain coupled to an eight node.

16. The apparatus of claim 15, further comprising:

a sixth MOS transistor that includes a source coupled to the second node, and a gate and drain coupled to the eighth node; and a seventh MOS transistor that includes a source coupled to the second node, a gate coupled to the eighth node, and a drain coupled to the ninth node.

17. The apparatus of claim 15, further comprising:

a sixth MOS transistor that includes a source coupled to a ninth node, and a gate and drain coupled to the fourth node;

a seventh MOS transistor that includes a source coupled to the second node, a gate coupled to the fourth node, and a drain coupled to the ninth node; and an eighth MOS transistor that includes a source coupled to the second node, a gate coupled to the fourth node, and a drain coupled to the sixth node.

18. The apparatus of claim 15, further comprising a sixth MOS transistor that includes a source coupled to the fifth node, a gate coupled to the first node, and a drain coupled to the third node.

19. The apparatus of claim 15, wherein each of the long channel MOS transistor, the first MOS transistor, the second MOS transistor, the fourth MOS transistor and the fifth MOS transistor are p-type transistors, and wherein the third MOS transistor is an n-type transistor.

20. The apparatus of claim 15, wherein each of the long channel MOS transistor, the first MOS transistor, the second MOS transistor, the fourth MOS transistor and the fifth MOS transistor are n-type transistors, and wherein the third MOS transistor is a p-type transistor.

* * * * *